United States Patent [19]

Spierer et al.

[11] Patent Number: 4,603,791

[45] Date of Patent: Aug. 5, 1986

[54] REFUND BOTTLE AND CAN BAG

[76] Inventors: Stuart Spierer; George Spector, both of 233 Broadway, Rm. 3615, New York, N.Y. 10007

[21] Appl. No.: 697,053

[22] Filed: Jan. 31, 1985

[51] Int. Cl.[4] ..... B65D 25/16; B65D 37/00; G06M 7/04

[52] U.S. Cl. ..... 220/404; 206/459; 220/1 T; 220/20.5; 220/94 A; 232/44; 235/98 R; 235/123; 377/6; 377/15; 383/6; 383/23; 383/43

[58] Field of Search ..... 377/15, 6, 82; 232/43.1, 43.2, 48, 44, 7; 383/43, 6, 7, 23, 86; 220/404, 403, 20.5, 1 T, 94 A, 410; 235/98 R, 123; 206/459

[56] References Cited

U.S. PATENT DOCUMENTS

| | | | |
|---|---|---|---|
| 1,026,081 | 5/1912 | Dorais | 220/404 X |
| 1,285,477 | 11/1918 | Valentine | 220/1 T X |
| 1,941,871 | 1/1934 | Struve | 220/404 X |
| 2,142,712 | 10/1945 | Gilchrist | 220/94 A |
| 2,225,089 | 12/1940 | Vadnais | 383/43 |
| 2,731,204 | 1/1956 | Darling et al. | 377/6 |
| 2,960,136 | 11/1960 | Ziff | 383/43 X |
| 3,063,591 | 11/1962 | Gaginestra | 220/1 T |
| 3,070,297 | 12/1962 | Mehlman | 235/98 R X |
| 3,292,813 | 12/1966 | Roegner | 220/404 |
| 3,502,238 | 3/1970 | Kelly | 220/404 |
| 3,825,150 | 7/1974 | Taylor | 220/1 T |
| 3,964,630 | 6/1976 | Getz | 220/404 |
| 4,095,092 | 6/1978 | Neff | 377/6 |
| 4,545,062 | 10/1985 | Pray | 377/6 |

*Primary Examiner*—Allan N. Shoap

[57] ABSTRACT

A disposable bag for returning refund bottles to a store is provided that consists of a body of thin flexible sheet material being wide and long enough to accommodate refund bottles of a two liter size which will fit into the proper size container for support and have a counting device built within the container to tally the amount of bottles deposited within.

6 Claims, 4 Drawing Figures

REFUND BOTTLE AND CAN BAG

BACKGROUND OF THE INVENTION

The instant invention relates generally to thermoplastic bags and more specifically it relates to disposable bag for returning refund bottles to a store.

Numerous thermoplastic bags have been provided in prior art that are adapted to be fabricated with handles for easy carrying. For example, U.S. Pat. Nos. 3,282,493; 3,558,039 and 3,924,802 all are illustrative of such prior art. While these units may be suitable for the particular purpose to which they address, they would not be as suitable for the purpose of the present invention as heretofore described.

SUMMARY OF THE INVENTION

A principle object of the present invention is to provide a disposable bag for returning refund bottles to a store that is just long and wide enough to accommodate the two liter size bottle.

Another object is to provide a disposable bag for returning refund bottles to a store that will fit into the proper size container for support.

An additional object is to provide a disposable bag for returning refund bottles to a store that has a counting device built within the container so as to tally the amount of bottles deposited within the bag.

A further object is to provide a disposable bag for returning refund bottles to a store that is economical in cost to manufacture.

A still further object is to provide a disposable bag for returning refund bottles to a store that is simple and easy to use.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
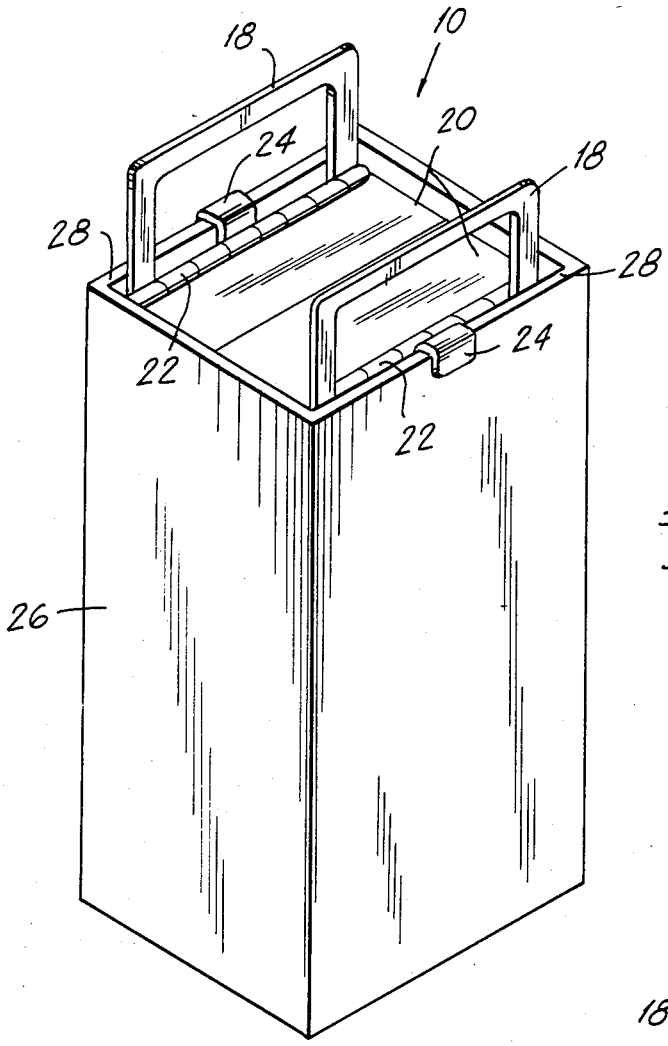
FIG. 1 is a perspective view of the invention.
Figure 2:
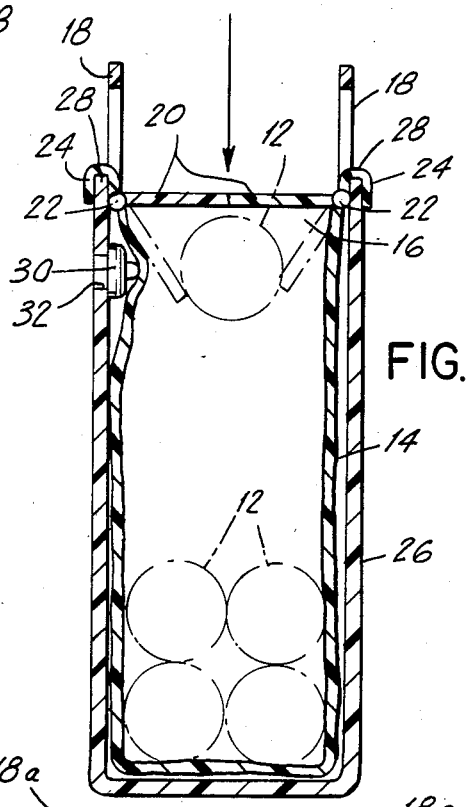
FIG. 2 is a cross sectional view taken along line 2—2 in FIG. 1.

Turning now descriptively to the drawings, in which similar reference characters denote similar elements throughout the several views, FIGS. 1 and 2 illustrates a disposable bag 10 for returning refund bottles 12 to a store. The bag 10 consists of a body 14 of thin flexible sheet material having an opening at top end to form a mouth 16. The body 14 is wide and long enough to accommodate the refund bottles 12 of a two litter size.

A pair of handles 18, 18 extends upwardly from opposite sides of the mouth 16 of the body 14 so that the body can be carried.

A pair of trap doors 20, 20 are provided. Each trap door 20 is hingeably affixed at 22 to the mouth 16 of the body 14 below one of the handles 18 and extends inwardly half way across the mouth 16.

A pair of hook members 24, 24 are provided. Each hook member 24 is affixed to the hinge 22 of one of the trap doors 20 and extends outwardly away from the mouth 16 of the body 14. An elongated container 26 has an opening at top end to form a rim 28 so that the body 14 can fit into the container 26 with the hook members 24, 24 engaging the rim 28 for support.

Figure 3:
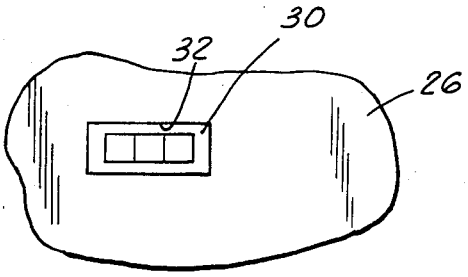
FIG. 3 is a partial rear view showing the window within the container with the counter numbers exposed.

A counting device 30 is built within the container 26 near the rim 28 to be activated by one of the trap doors 20 whereby the counting device 30 will tally amount of the refund bottles 12 deposited within the body 14. The container 26 has a window 32, as best shown in FIG. 3, to display numerals 34 from the counting device 30 for easy viewing.

Figure 4:
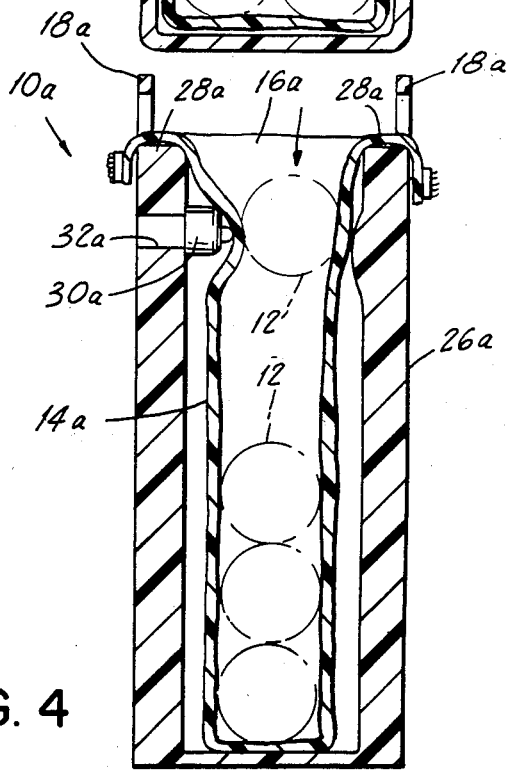
FIG. 4 is a cross sectional view similar to FIG. 2 showing a modification thereof.

A modified disposable bag **10*a* for returning refund bottles 12 to a store is shown in FIG. 4. The bag 10*a* consists of a body 14*a* of thin flexible sheet material that has an opening at top end to form a mouth 16*a*. The body 14*a* is wide and long enough to accommodate the refund bottles 12** of a two litter size.

An elongated container **26*a* is provided and has an opening at top end to form a rim 28*a* so that the body 14*a* can fit into the container 26*a* with the mouth 16*a* drapped over the rim 28*a* of the container 26*a***.

A pair of handles **18*a*, 18*a* extends upwardly from opposite sides of the rim 28*a* of the container 26*a*** so that the container can be carried.

A counting device **30*a* is built within the container 26*a* near the rim 28*a* to be activated by one refund bottle 12 whereby the counting device 30*a* will tally amount of the refund bottles 12 deposited within the body 14*a*. The container 26*a* has a window 32*a* to display numerals from the counting device 30*a*** for easy viewing.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A disposable bag adapted to be removably mounted in a container having a rim, comprising:

(a) a body of thin flexible sheet material having an opening at top end to form a mouth, said body being wide and long enough to accomodate refund bottles of a two liter size;

(b) a pair of handles extending upwardly from opposite sides of said mouth of said body so that said body can be carried;

(c) a pair of trap doors, each said trap door hingeably affixed to said mouth of said body below one of said handles and extending inwardly half way across said mouth;

(d) a pair of hook members, each said hook member affixed to said hinge of one of said trap doors and extending outwardly away from said mouth of said body.

2. A disposable bag as in claim 1, in combination with a container in which said bag is mounted wherein said hooks are supported at the top of said container's rim.

3. A disposable bag for returning refund bottles to a store as recited in claim 2, further comprising a counting device built within said container near said rim to be activated by one of said trap doors whereby said counting device will tally amount of said refund bottles deposited within said body.

4. A disposable for returning refund bottles to a store as recited in claim 3, wherein said container further comprises a window to display numerals from said counting device for easy viewing.

5. A disposable bag for returning refund bottles to a store as recited in claim 2, further comprising a counting device built within said container near said rim to be activated by one said refund bottle whereby said counting device will tally amount of said refund bottles deposited within the body.

6. A disposable bag for returning refund bottles to a store as recited in claim 5, wherein said container further comprises a window to display numerals from said counting device for easy viewing.

* * * * *